United States Patent [19]

Cros

[11] 3,968,030

[45] July 6, 1976

[54] METHOD AND AN INSTALLATION FOR IMPROVING THE ENERGY BALANCE OF INSTALLATIONS FOR PROCESSING CHEMICAL PROCESS STREAMS AND ESPECIALLY PETROLEUM REFINERIES

[75] Inventor: Pierre Cros, Paris, France

[73] Assignees: Spie-Batignolles; Societe Generale de Techniques et d'Etudes, both of Puteaux, France

[22] Filed: Jan. 3, 1975

[21] Appl. No.: 538,380

[30] Foreign Application Priority Data

Jan. 17, 1974 France ..... 74.0501541

[52] U.S. Cl. ..... 208/347; 208/353; 208/354; 208/365; 196/120; 196/134

[51] Int. Cl.[2] ..... C10G 7/00

[58] Field of Search ..... 208/92, 93, 94, 347, 208/353, 354, 364, 365; 196/120, 134

[56] References Cited

UNITED STATES PATENTS

| | | | |
|---|---|---|---|
| 1,555,531 | 9/1925 | Trumble | 196/120 |
| 1,580,372 | 4/1926 | Hazeldine | 196/120 |
| 2,938,865 | 5/1960 | Moyer | 208/347 |

*Primary Examiner*—Herbert Levine
*Attorney, Agent, or Firm*—Young & Thompson

[57] ABSTRACT

In a chemical processing plant such as a petroleum refinery, provision is made for steam boilers and heating furnaces in which the energy consumed by the boilers for generating steam exceeds the energy consumed by the heating furnaces. The steam is produced at a pressure level which is sufficient to operate at least one back-pressure turbo-alternator, then to heat the chemical process stream to a sufficiently high temperature by heat exchange with the steam recovered at the outlet of the turbo-alternator.

8 Claims, 3 Drawing Figures

METHOD AND AN INSTALLATION FOR IMPROVING THE ENERGY BALANCE OF INSTALLATIONS FOR PROCESSING CHEMICAL PROCESS STREAMS AND ESPECIALLY PETROLEUM REFINERIES

This invention relates to a method for improving the energy balance of installations for processing chemical process streams and especially petroleum refineries.

The invention is also directed to an improved installation for refining crude oil which makes it possible in particular to carry the method aforesaid into practical effect.

In known petroleum refineries, the energy employed is distributed in the following manner:

a large fraction of the total consumed energy is used for heating furnaces including the furnace which is placed upstream of the crude oil distillation column. The furnace just mentioned serves to heat the crude oil to a temperature of approximately 350°C prior to distillation. In the case of conventional refineries which process 2 to 4 millions of tons of petroleum per annum, the energy employed for heating all the furnaces represents in the majority of instances 60 to 70% of the total energy consumed.

The other fraction of the total consumed energy is used to heat boilers for producing steam at a pressure which does not exceed 60 bars and is limited in most cases to about 45 bars.

The steam just mentioned is employed successively for the operation of turbo-alternators in order to produce the electric power required by the refinery and then for the operation of different units of the installation.

The present invention overcomes various drawbacks which are attached to current practice.

One of the disadvantages of known refining installations arises from the fact that the efficiency of the furnaces employed for heating crude oil does not usually exceed 83%. An appreciable fraction of the energy delivered is in fact lost in the flue gases produced by combustion of hydrocarbons supplied to the furnaces. This loss affects the overall energy balance of the refinery to a considerable extent and this is made worse by the present high price of hydrocarbons.

In order to improve the power efficiency of oil refineries, steps have accordingly been taken to provide waste heat boilers which operate on the principle of heat exchange with the flue gases produced by the furnaces. However, the temperature of the flue gases and the quantity of heat available in these latter is too low to produce steam at a sufficiently high pressure to permit advantageous production of mechanical energy. In point of fact, the pressure of the steam produced by these waste heat boilers does not usually exceed 30 bars.

A further drawback of known refineries arises from the fact that they employ only a small proportion of the total energy for the production of steam. In the most general case of refineries which process 2 to 4 million tons of crude oil per annum, the energy used in order to produce the steam in fact represents only 30 to 40% of the total energy. The electric power supplied by expansion of this steam within the turbo-alternators is consequently of a low order.

A third disadvantage of known refineries lies in the fact that the heating stations constituted by the furnaces and the boilers are separated both geographically and administratively since they are employed independently for quite different purposes. This separation is also likely to affect the overall energy balance of the refinery for reasons which can readily be understood.

In an article published by Follea in "Revue des Techniciens Francais du Petrole," November–December 1972, page 73, it is disclosed that the energy employed in a petroleum refinery breaks down as follows:

| | |
|---|---|
| heating of process streams | 50 % |
| loss in flue gases | 16.60 % |
| process steam | 5 % |
| reheat steam | 14 % |
| loss from steam condensation | 8 % |
| mechanical energy | 6.40 % |

The essential aim of the invention is precisely to improve the energy balance of petroleum refineries under conditions which are particularly advantageous, especially when taking into account the high cost of crude oil.

The means contemplated by the invention are also intended to improve the energy balance of installations for the separation, production or conversion of different chemical products of crude oil such as the alcohols, vinyl chloride and the like, in which a high proportion of fuel oil is used.

In accordance with the invention, the method for improving the energy balance of installations for processing chemical process streams and especially petroleum refineries is distinguished by the fact that a preponderant part of the total consumed energy is employed for producing steam, that the steam is produced at a sufficiently high pressure level to carry out successively the operation of at least one back-pressure turbo-alternator followed by heating of the chemical process stream to be processed to a sufficient temperature to ensure conversion of said stream by heat exchange with the steam thus recovered at the outlet of the turbo-alternator.

By preponderant part of the total consumed energy is meant a fraction which is significantly larger than the fraction of energy employed in the known installations for producing steam. Said preponderant part attains 50% of the total quantity of consumed energy in some favorable instances.

By using a preponderant fraction of energy to produce steam and bringing this latter to a sufficient level to permit direct heating of the chemical process stream to be processed, it is possible to achieve a very appreciable gain in the overall energy balance of the installation.

Accordingly, the fact of heating the stream to be processed by means of steam makes it possible to avoid the use of furnaces whose efficiency is lower than that of the boilers by at least 10%.

In an advantageous embodiment of the invention which is applied to the case of distillation of crude oil, the fraction of energy consumed in order to produce steam is preferably within the range of 40 to 70% and the pressure of the steam produced in the boilers is preferably higher than 120 bars.

This energy fraction is distinctly larger than the fraction employed in the case of known refineries in which the crude oil is heated by means of furnaces prior to distillation.

The pressure of steam produced is also distinctly higher than that employed in conventional refineries. The production of steam at a pressure level higher than 120 bars makes it possible to heat the crude oil to a temperature above 290°C which is sufficient to carry out distillation without any other heating means.

The fact of producing steam at a high pressure also makes it possible to obtain higher electric power by means of the turbo-alternators. This excess power can be advantageously employed to supply means for heating by Joule effect, which was not considered to be feasible in conventional refineries.

By producing steam at a pressure which is preferably higher than or equal to 120 bars, it is also possible to employ part of the steam produced for the purpose of reboiling the bottom of the distillation columns. This dispenses with the conventional method which consists in injecting steam into the bottom of the columns and calls for subsequent separation of the condensed water.

The petroleum refinery installation contemplated by the invention comprises at least one boiler for the production of steam, means for feeding said steam to different points of the installation, at least one crude oil distillation column and at least one back-pressure turbo-alternator which uses part of the steam produced.

In accordance with the invention, the installation essentially comprises:

at least one turbo-alternator which is so arranged as to receive the high-pressure steam and to produce the expansion of the steam at different pressure levels, the highest level being such as to correspond to the temperature required for heating the crude oil to be distilled, at least one heat-exchanger placed upsteam of the crude oil distillation column and so arranged as to heat the crude oil by means of the steam produced, means for conveying the steam recovered at the outlet of the turbo-alternator to the aforementioned heat-exchanger.

The installation in accordance with the invention is distinguished from conventional structures by the absence of furnaces for heating the crude oil prior to distillation, said furnaces having been replaced by heat-exchangers which operate in conjunction with one or a number of high-pressure boilers and one or a number of turbo-alternators.

In a preferred embodiment of the invention, this installation comprises a second distillation column placed downstream of the atmospheric distillation column, said second column being associated with means for reducing the distillation pressure.

Said second distillation column operates at low pressure and therefore makes it possible to reduce the temperature of distillation of petroleum process streams. When the steam pressure is equal to 120 bars, the crude oil heating temperature is in fact limited to 280°–290°C, which is insufficient to effect complete distillation of crude oil within the first column. The second column thus ensures a complementary distillation.

Further particular features and advantages of the invention will become apparent from the following description, reference being made to the accompanying drawings which are given by way of example without any implied limitation, and in which.

Figure 1:
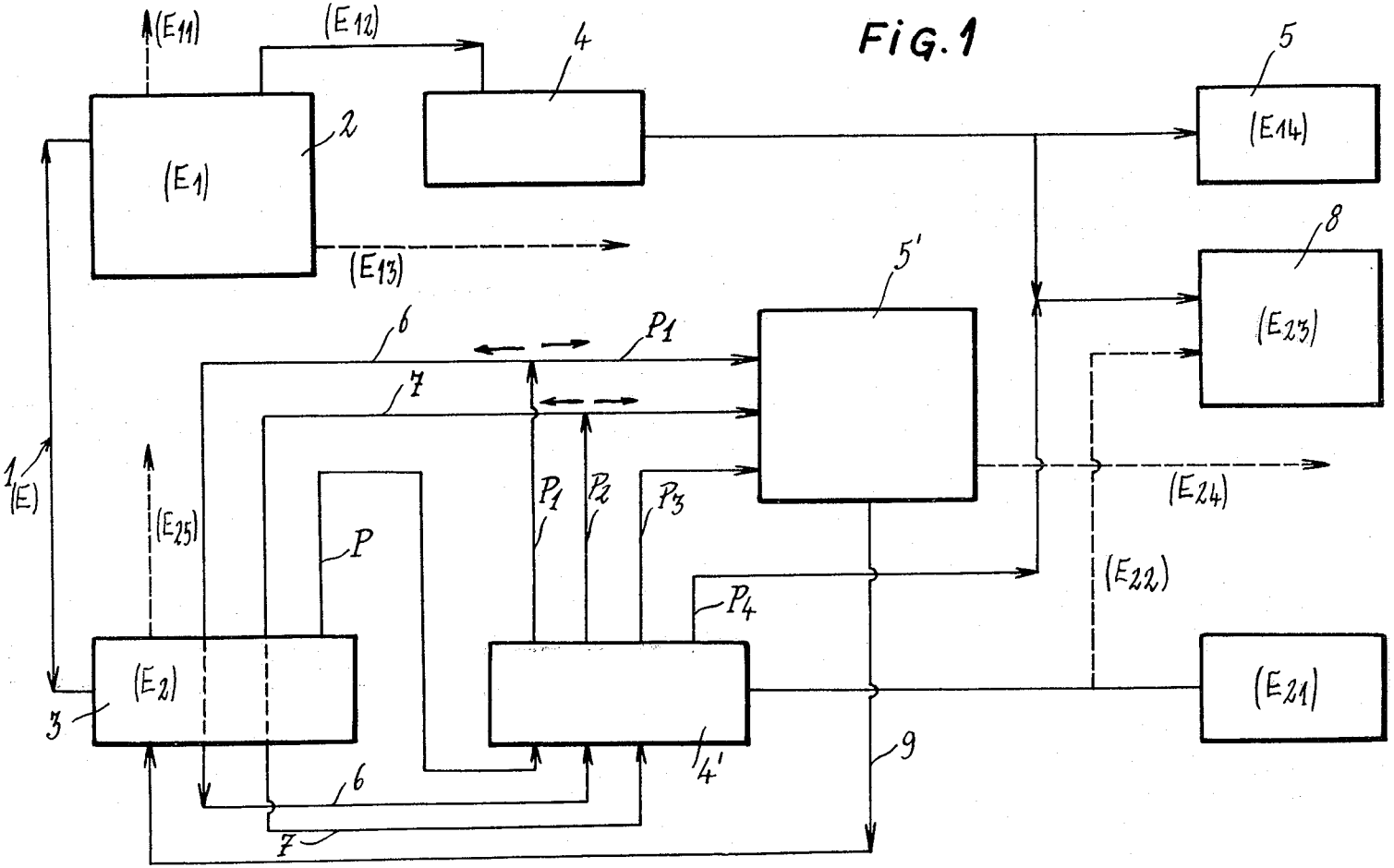
FIG. 1 is a diagram relating to the method.

With reference to the diagram of FIG. 1, the method for improving the energy balance of a petroleum refinery comprises the following particular features:

a part $E_1$ of the total energy E consumed in the form of fuel-oil admitted at 1 is employed for the operation of the furnaces designated at 2, the efficiency of which attains 83% only under exceptional conditions;

a part $E_2$ of the total energy E is employed for the operation of the boilers designated at 3, the efficiency of which is within the range of 90% to 93%.

In accordance with the invention, $E_2$ represents a preponderant part of the total energy E and can be higher than the energy $E_1$ used by the furnaces 2. The energy $E_2$ used for the operation of the boilers 3 represents in this case a distinctly larger fraction of the total energy E than in known refineries.

A part $E_{11}$ of the energy $E_1$ used by the furnaces 2 is lost in the flue gases whilst another part $E_{12}$ is employed for the operation of waste heat boilers 4 which usually deliver steam at a moderate pressure or so-called "process steam" as designated by the reference 5.

The energy consumed for heating petroleum process streams by means of the furnaces 2 is designated by the reference $E_{13}$.

Additionally in accordance with the invention, the steam is produced by the boilers 3 at a sufficiently high pressure level to ensure the operation of the back-pressure turbo-alternators 4' followed by heating of the crude oil at 5' prior to distillation by heat exchange with the steam recovered at the outlets of the turbo-alternators 4'.

The pressure (P) of the steam produced within the boilers 3 is preferably higher than 120 bars. In addition, the steam is expanded after passing through the turbo-alternators 4', preferably at four pressure levels $P_1$, $P_2$, $P_3$, $P_4$ which are respectively equal in the example under consideration to 120 bars, 35 bars, 12 bars and 4.5 bars approximately.

In the case of a steam pressure $P_1$ equal to 120 bars, a heat exchange process makes it possible to heat the crude oil prior to distillation to a temperature equal to 280°–290°C which is usually sufficient to ensure at least partial distillation of the crude oil.

It is further apparent that part of the steam recovered at the outlets of the turbo-alternators 4' at the pressures $P_1$ (120 bars) and $P_2$ (35 bars) is recycled at 6 and 7 to the boilers 3 in order to be resuperheated.

This arrangement makes it possible to bring the steam into a new state of equilibrium which is favorable to the production of energy in the following expansion or expansions.

The fact that the energy $E_2$ consumed by the boilers 3 is of high value makes it possible for the turbo-alternators 4' to deliver a high value of electrical energy $E_{21}$ which is amply sufficient for the requirements of mechanical driving of the refinery and on the other hand a part $E_{22}$ for reheating units of the refinery in some cases by Joule effect.

The other part of the energy $E_{23}$ expended for reheating as designated by the reference 8 is derived from the steam produced by the waste heat boilers 4 and from the steam having the lowest pressure such as $P_4$.

The energy expended for heating the crude oil at 5' is designated by the reference $E_{24}$. The steam which is condensed after heat exchange at 5' with the crude oil is recycled to the boilers 3 at 9.

There is given hereunder the energy balance in thousands of constant thermal units per hour of two petroleum refineries A and B respectively of 2 and 4 millions of tons per annum, said refineries being equipped in accordance with the method contemplated by the invention.

| | | A | B |
|---|---|---|---|
| E | (total energy consumed) | 98 | 245 |
| $E_1$ | (furnaces) | 31 | 125 |
| $E_2$ | (boilers) | 67 | 120 |
| $E_{11}$ | (flue gases of furnaces) | 6 | 25 |
| $E_{12}$ | (waste heat boilers) | 5 | 10 |
| $E_{13}$ | (heating of process streams by the furnaces) | 20 | 90 |
| $E_{14}$ | (process steam) | 4 | 9 |
| $E_{21}$ | (mechanical power) | 9 | 18.5 |
| $E_{22}$ | (Joule-effect heating) | 1 | 1.5 |
| $E_{23}$ | (total heat energy of reheating) | 22 | 30 |
| $E_{24}$ | (heating of process streams by steam) | 30 | 60 |
| $E_{25}$ | (flue gases of the boilers) | 7 | 12 |
| | Losses from condensation | 0 | 0 |

There is given below by way of comparison the energy balance in thousands of constant thermal units per hour of two conventional refineries A′ and B′ respectively of 2 and 4 millions of tons per annum.

| | A′ | B′ |
|---|---|---|
| Total energy consumed | 120 | 300 |
| Furnaces | 70 | 210 |
| Boilers | 50 | 90 |
| Furnace flue gases | 13.5 | 40 |
| Waste heat boilers | 6.5 | 20 |
| Heating of process streams by the furnaces | 50 | 150 |
| Process steam | 6 | 15 |
| Mechanical power | 8.7 | 20 |
| Thermal energy of reheating | 28 | 42 |
| Boiler flue gases | 5 | 10 |
| Losses from condensation | 8.8 | 24 |

In comparison with these conventional refineries A′ and B′, the refineries A and B equipped in accordance with the invention therefore have the following advantages:

Losses from condensation are eliminated by making much more extensive use of back-pressure turbo-alternators. The corresponding gain achieved is of the order of 8% of the total consumption.

The use of boilers instead of furnaces for heating the petroleum prior to distillation makes it possible to achieve a gain within the range of 3 to 4% of the total consumption.

The replacement of part of the thermal reheating of certain units by means of low-pressure steam below 10 bars by intermittent Joule-effect reheating permits a gain of the order of 4%.

The overall gain is therefore of the order of 15 to 16%. This gain can be further improved by employing part of the steam at 120 bars recovered at the outlets of the back-pressure turbo-alternators in order to carry out reboiling of the bottom of the distillation columns to replace the injection of steam into the lower ends of the columns. It is thus possible to recover an additional 1 to 2% of the overall consumption. Reboiling also eliminates the need for separation of the water from the distilled products.

Figure 2:
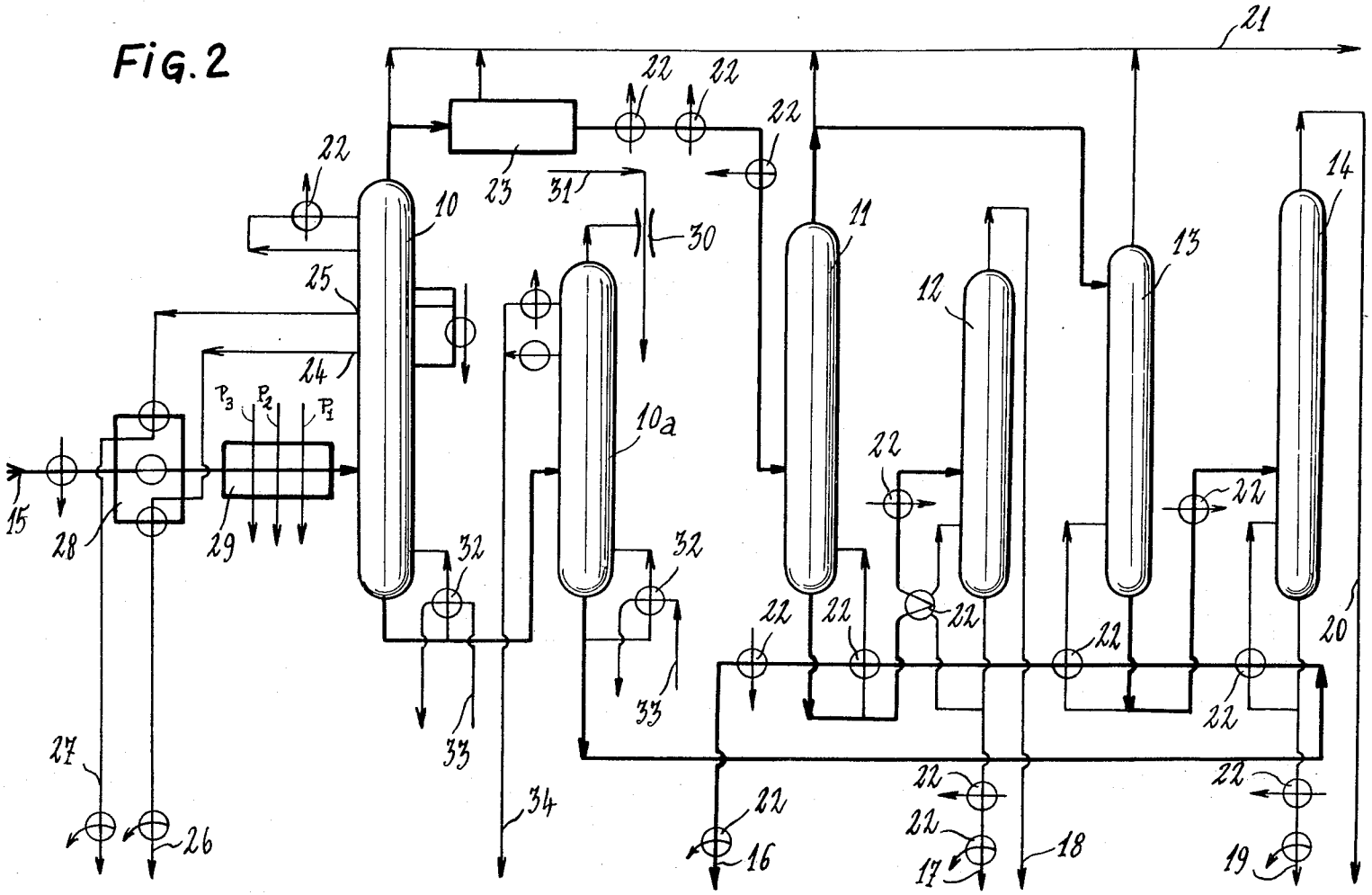
FIG. 2 is a diagram of one portion of the installation in accordance with the invention.

In the embodiment of FIG. 2, the petroleum refinery installation comprises in known manner an atmospheric distillation column 10 and a series of conventional columns 11, 12, 13 and 14 for the separation of butane, motor fuels, ethane and propane. The crude oil feed is shown at 15. The heavy fuel oil is recovered at 16, the heavy motor fuel is recovered at 17, the light motor fuel at 18, the butane at 19 and the propane at 20. The light fuel gases are discharged at 21. The heat exchangers or reboilers shown at 22 are of conventional design. The hydrotreating unit 23 connected to the top of the atmospheric distillation column 10 is also conventional. The gas oil and the kerosene are withdrawn at certain levels 24 and 25 of the column 10 and recovered at 26 and 27 after passing through the heat-exchange unit 28.

The block 29 designates a series of heat exchangers supplied with steam produced at different pressure levels $P_1$, $P_2$, $P_3$ for heating the crude oil prior to introduction into the atmospheric distillation column 10.

In the embodiment which is illustrated, it is also seen that the installation comprises a second distillation column 10*a* placed downstream of the atmospheric distillation column 10. Said column 10*a* operates at low pressure, for example within the range of 80 to 140 torr. The means for producing said low pressure can be constituted for example by an ejector 30 supplied at 31 with steam at a pressure equal to about 10 bars. Said column 10*a* makes it possible to reduce the temperature of distillation of the petroleum products which pass into the column.

It can also be seen that a reboiler 32 supplied for example at 33 with steam at a pressure equal to 120 bars is placed near the bottom of each column 10 and 10*a*. The reboilers 32 serve to replace the injection of steam into the bottom of each column.

An installation of this type preferably has the following operating characteristics:

| | |
|---|---|
| Rate of feed of crude oil | 6000 t/d |
| Rate of production of kerosene recovered at 27 | 400 t/d |
| Rate of production of gas oil recovered at 26 | 450 t/d |
| Rate of production of gas oil recovered at 34 | 800 t/d |
| Rate of production of fuel oil recovered at 16 | 3100 t/d |
| Rate of production of heavy motor fuel recovered at 17 | 800 t/d |
| Rate of production of light motor fuel recovered at 18 | 300 t/d |
| Rate of production of butane recovered at 19 | 100 t/d |
| Rate of production of propane recovered at 20 | 10 t/d |
| Rate of production of fuel gases recovered at 21 | 40 t/d |
| Temperature of crude oil at inlet of heat-exchanger 29 | 100°C |
| Temperature of crude oil at outlet of heat-exchanger 29 | 290°C |
| Temperature at bottom of column 10 | 280°C |
| Temperature at top of column 10 | 120°C |
| Pressures of steam fed to heat-exchanger 29 | 12 bars<br>45 bars and<br>120 bars. |

Figure 3:
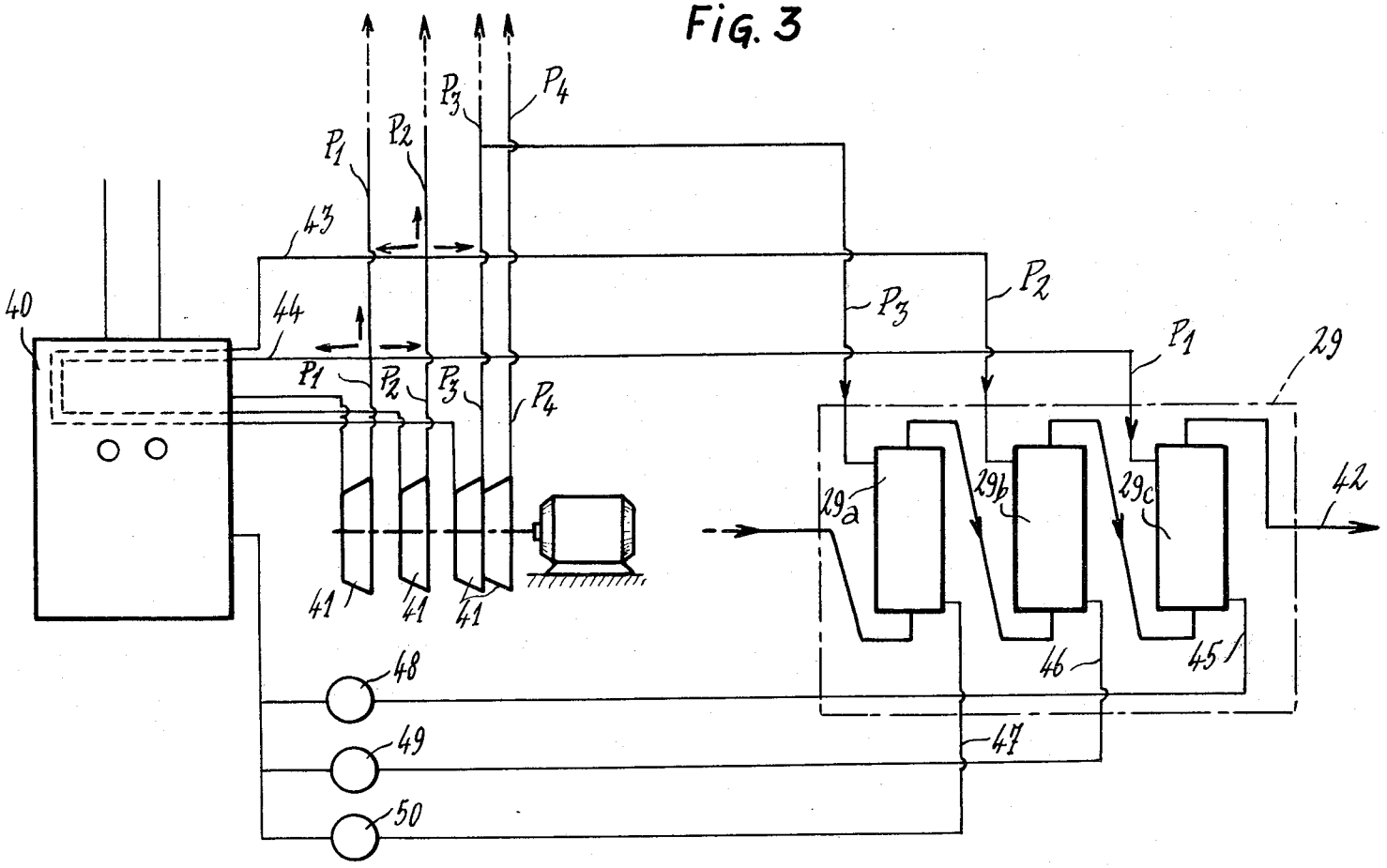
FIG. 3 is a diagram of another portion of the installation in accordance with the invention.

In the embodiment of FIG. 3, it is seen that the installation additionally comprises a boiler 40, said boiler having been tested to produce steam at a pressure which is preferably higher than 120 bars in order to feed a back-pressure turbo-alternator 41.

In accordance with the invention, said turbo-alternator 41 is so arranged as to receive the steam at a pressure which is higher than 120 bars and in order to expand this latter at different pressure levels $P_1$, $P_2$, $P_3$, $P_4$. The highest pressure level $P_1$ (for example equal to 120 bars) corresponds to the pressure required to bring the crude oil discharged at 42 from the heat-exchanger 29 at a sufficient temperature to ensure that the distillation can be performed within the atmospheric distillation column 10 (as shown in FIG. 2).

In a preferred example of construction, the pressure levels $P_2$, $P_3$ and $P_4$ are respectively equal to 45 bars, 12 bars and 4.5 bars.

Part of the steam expanded after passing through the turbo-alternator 41 is employed for supplying the three stages 29*a*, 29*b*, 29*c* of the heat-exchanger 29, respectively with steam at the three aforementioned pressure levels $P_3$, $P_2$ and $P_1$.

Another fraction of the steam at the pressure $P_2$ and $P_1$ is recycled at 43 and 44 to the boiler 40 in order to be resuperheated.

A third fraction of the steam at the pressure $P_3$, $P_2$ and $P_1$ as well as the steam at the pressure $P_4$ is directed to other points of the installation such as, for example, the reboilers 32 (see FIG. 2).

The steam condensed after passing through the three stages of the heat-exchanger 29 is recycled at 45, 46 and 47 by means of pumps 48, 49 and 50.

An installation of this type does not give rise to any special constructional problems. Furthermore, the transfer of steam at a pressure of the order of 120 bars represents a level of expenditure which is somewhat lower at equal weight than the level corresponding to the transfer of steam in known structures at a pressure of about 45 bars.

The majority of equipment units of the installation such as columns, heat-exchangers, piping and the like are also standard elements which do not call for any special adaptation.

The results achieved in the improvement of the energy cycle of two petroleum refinery installations are recorded hereunder.

EXAMPLE 1

In this example, consideration is given to a refinery of small size, having a rated capacity of 670,000 tons per annum and equipped to carry out distillation of crude oil, processing of motor fuels and catalytic reforming.

The steam required for the installation is supplied by a boiler which produces the steam at 120 bars superheated to 450°C. The high-pressure steam is employed for the operation of an electric generator, then passed into heat-exchangers for distillation and reboiling of the crude oil within a temperature range of 230° to 300°C.

The steam condensed in the heat-exchangers is recovered at 45 bars.

This steam at 45 bars is in turn employed:

for reboiling the bottom of the catalytic reforming stabilization column, for preheating the feedstock to and reboiling the bottom of the light motor fuel stabilization, and for the atomization vapor of the catalytic reforming furnace and supplying heat for the hydrotreating of motor fuels.

Compared with a conventional installation having the same capacity, there is thus achieved an economy of fuel consumption of 28%.

EXAMPLE 2

In this example, consideration is given to a refinery of medium size.

The high-pressure steam system consists in this case of two steam circuits:

the first steam circuit at 160 bars and 380°C supplies the installation directly with process steam and the condensed steam returns directly to the boiler, the second steam circuit at 155 bars and 480°C is fed to the turbo-alternator having a back-pressure of 16 bars and withdrawal at 45 bars.

The 45-bar system also feeds the process steam installation.

The 16-bar system receives the condensed steam from the 45-bar system and is primarily employed for reheating the combustion air of the boilers and of the process furnaces.

The last system at a pressure of 4.5 bars is employed especially for reheating the end product tanks.

In comparison with a conventional refinery of medium size, the theoretical consumption of the refinery with respect to crude oil is reduced from 4.55% to 3.65%, namely a gain of nearly 20%.

It consequently appears from the description that the method and installation in accordance with the invention primarily offer the following advantages:

they essentially permit a reduction of 17 to 28% in the overall energy consumption of the refinery. Moreover, this reduction does not take into account the operational savings resulting from the concentration of the heating means constituted by the furnaces and boilers.

By reducing the energy consumption, the invention makes it possible in addition to reduce the emission of flue gases and consequently to reduce pollution.

In one of its aspects, the invention also simplifies the problem of separation of water from hydrocarbons by dispensing with the need for injections of steam into the bottoms of columns and making provision instead for reboiling operations carried out by means of high-pressure steam.

Furthermore, by making use of turbo-alternators for producing high electric power which can exceed the normal requirements of the refinery, certain units can be heated continuously, partially or totally by Joule effect. In addition and by reason of the fact that it can readily be employed intermittently, this mode of heating over short periods of time can consequently be advantageously employed to replace the operations previously adopted for reheating certain equipment units, without any regulation by means of low-pressure steam.

The invention is clearly not limited to the practical examples which have just been described and can also be applied in particular to the treatment of products other than crude oil such as, for example, the distillation of alcohols, the synthesis of vinyl chloride and the like.

The installation can also be coupled with a thermal power plant or nuclear power station in which means are provided for producing high-pressure steam, thus replacing the high-pressure boiler as contemplated by the invention.

I claim:

1. A method for improving the energy balance of a petroleum refinery in which crude oil is heated and then distilled in at least one distillation column, comprising the steps of producing steam in a boiler at a pressure of at least about 120 bars, feeding said steam to a back-pressure turbo-alternator that has a plurality of turbine stages that are driven by steam at a plurality of successively lower pressures with the steam moving from stage to stage of said turbine stages as the steam progressively decreases in pressure and in temperature, withdrawing steam from each of a plurality of said turbine stages thereby to produce a plurality of streams of steam of successively different temperature and pressure, heating said crude oil by indirect heat exchage with each of said streams in succession in progressively ascending order of temperature and pressure of said streams, and feeding said heated crude oil into said at least one distillation column after said heat exchange with said stream of highest temperature and pressure.

2. A method as claimed in claim 1, in which steam leaving said plurality of turbine stages has a pressure range of about 120 bars to about 4 bars.

3. A method as claimed in claim 1, in which part of the steam recovered at the outlet of the turbine stages is recycled to the boiler for reheating.

4. A method as claimed in claim 1, in which part of the steam from the boiler is used in indirect heat exchange to reboil the bottoms of said at least one distillation column.

5. A petroleum refinery comprising at least one distillation column, a plurality of heat exchangers for progressively heating crude oil by indirect heat exchange to successively higher temperatures prior to introducing the heated crude oil into said at least one distillation column, a boiler for producing steam at a pressure of at least about 120 bars, a back-pressure turbo-alternator that has a plurality of turbine stages that are driven by steam at a plurality of successively lower pressures, means to feed steam from said boiler to the highest pressure stage of said turbine stages with the steam moving from stage to stage of said turbine stages as the steam progressively decreases in pressure and in temperature, means for withdrawing steam from each of a plurality of said stages of said turbine stages thereby to produce a plurality of streams of steam of successively different temperature and pressure, and means to pass said streams separately each to a respective one of said heat exchangers in an order such that crude oil moving toward said at least one distillation column is heated in said heat exchangers by indirect heat exchange with said streams in progressively ascending order of temperature and pressure of said streams.

6. A refinery as claimed in claim 5, said heat exchangers receiving steam from the outlet of the turbine stages within a pressure range of about 120 to about 12 bars.

7. A refinery as claimed in claim 5, there being a second distillation column downstream from said at least one distillation column, means for passing bottoms from said first distillation column as feed to said second distillation column, and means maintaining said second distillation column under a lower pressure than said first distillation column.

8. A refinery as claimed in claim 7, said first distillation column operating at about atmospheric pressure and said second distillation column operating at subatmospheric pressure.

* * * * *

UNITED STATES PATENT AND TRADEMARK OFFICE

CERTIFICATE OF CORRECTION

PATENT NO. : 3,968,030

DATED : July 6, 1976

INVENTOR(S) : Pierre CROS

It is certified that error appears in the above-identified patent and that said Letters Patent are hereby corrected as shown below:

Item [30], change the identification of the French priority application to --74.01541--.

Signed and Sealed this

Ninth Day of November 1976

[SEAL]

*Attest:*

RUTH C. MASON
*Attesting Officer*

C. MARSHALL DANN
*Commissioner of Patents and Trademarks*